US011338992B2

(12) United States Patent
Wiest

(10) Patent No.: US 11,338,992 B2
(45) Date of Patent: May 24, 2022

(54) PACKAGING HAVING MEANS FOR PASSIVE FLIGHT

(71) Applicant: Florian Wiest, Horb-Ahldorf (DE)

(72) Inventor: Florian Wiest, Horb-Ahldorf (DE)

( * ) Notice: Subject to any disclaimer, the term of this patent is extended or adjusted under 35 U.S.C. 154(b) by 37 days.

(21) Appl. No.: 16/286,722

(22) Filed: Feb. 27, 2019

(65) Prior Publication Data

US 2019/0185255 A1 Jun. 20, 2019

Related U.S. Application Data

(62) Division of application No. 13/512,252, filed as application No. PCT/DE2010/075142 on Nov. 24, 2010, now abandoned.

(30) Foreign Application Priority Data

Nov. 25, 2009 (DE) ..... 10 2009 055 616.8

(51) Int. Cl.
*B65D 85/60* (2006.01)
*B65D 81/36* (2006.01)

(52) U.S. Cl.
CPC ..... *B65D 85/60* (2013.01); *B65D 81/365* (2013.01)

(58) Field of Classification Search
CPC ..... B65D 85/60; B65D 81/365
USPC ..... 206/457; 446/34, 36, 37, 255
See application file for complete search history.

(56) References Cited

U.S. PATENT DOCUMENTS 1,413,316 A * 4/1922 Bradley ..... A63H 33/185 446/34
1,651,273 A * 11/1927 Heller ..... A63H 33/185 446/34
2,450,992 A 10/1948 Sanderson
2,454,616 A 11/1948 Schultz
2,615,281 A 10/1952 Main
2,700,517 A 1/1955 Stavely
2,784,755 A 3/1957 Bender
2,991,815 A 7/1961 Pfeiffer
3,119,196 A * 1/1964 Alberico ..... A63H 27/12 446/34
3,129,740 A 4/1964 Nourse et al.
3,273,834 A 9/1966 Bower
3,353,295 A 11/1967 Downey
3,755,962 A 9/1973 Walters et al.
4,333,265 A 6/1982 Arnold
4,583,703 A 4/1986 Kline
4,635,553 A 1/1987 Kane
4,714,444 A 12/1987 Rendel
4,756,253 A 7/1988 Herring et al.
(Continued)

FOREIGN PATENT DOCUMENTS

FR 1559224 3/1969

OTHER PUBLICATIONS

Pending Claims from Parent Case, U.S. Appl. No. 13/512,252.

*Primary Examiner* — Jacob K Ackun
(74) *Attorney, Agent, or Firm* — Renner, Otto, Boisselle & Sklar, LLP

(57) ABSTRACT

A packaging having at least one accommodating space configured for an object to be inserted therein is provided. The at least one accommodating space is openable via a hinge. The at least one rotor blade extends from the at least one accommodating space and causes an autorotation motion of the packaging during free fall.

5 Claims, 5 Drawing Sheets

(56) References Cited

U.S. PATENT DOCUMENTS 4,787,160 A * 11/1988 Balsamo ..... B42D 15/045 206/469
4,836,817 A 6/1989 Corbin
4,848,704 A 7/1989 Sams
4,886,222 A 12/1989 Burke
4,904,219 A * 2/1990 Cox ..... A63H 27/14 446/36
5,013,277 A * 5/1991 Hufeld ..... A63H 27/00 446/34
5,067,410 A 11/1991 Murnane, III et al.
5,090,636 A 2/1992 Sadowski
5,123,612 A 6/1992 Labroche et al.
5,173,069 A * 12/1992 Litos ..... A63H 33/185 446/36
5,240,448 A 8/1993 Ishikawa
5,284,454 A * 2/1994 Randolph ..... A63H 27/12 446/36
5,285,898 A 2/1994 Zinbarg et al.
5,312,286 A * 5/1994 Domen ..... A63H 27/06 446/187
5,505,650 A 4/1996 Harned
5,553,570 A * 9/1996 VanNatter, III ..... A01K 15/025 119/709
5,655,944 A 8/1997 Fusselman
5,779,052 A 7/1998 Woodford et al.
5,810,636 A * 9/1998 Hamed ..... A63H 33/185 446/265
6,244,463 B1 6/2001 Richards et al.
6,250,985 B1 * 6/2001 Nicholson ..... A63H 37/00 446/368
6,319,085 B1 11/2001 Coleman et al.
6,364,733 B1 * 4/2002 Escauriza ..... A63H 27/10 446/225
6,942,184 B1 9/2005 Morris
7,766,274 B1 8/2010 Jameson et al.
8,172,173 B2 5/2012 Carlson
2002/0166781 A1 11/2002 Andreas
2003/0096552 A1 * 5/2003 Nicholson ..... A63H 27/00 446/34
2003/0111359 A1 * 6/2003 Seliga ..... A45C 11/00 206/37
2003/0230514 A1 * 12/2003 Baker ..... B65D 51/245 206/732
2005/0014439 A1 1/2005 Erickson et al.
2006/0183398 A1 8/2006 Barnes
2008/0207080 A1 * 8/2008 Lapointe ..... A63H 33/20 446/49
2008/0274663 A1 * 11/2008 Dial ..... A63H 37/00 446/34
2010/0324754 A1 12/2010 Barrows
2012/0328441 A1 12/2012 Fogarty

* cited by examiner

FIG. 5
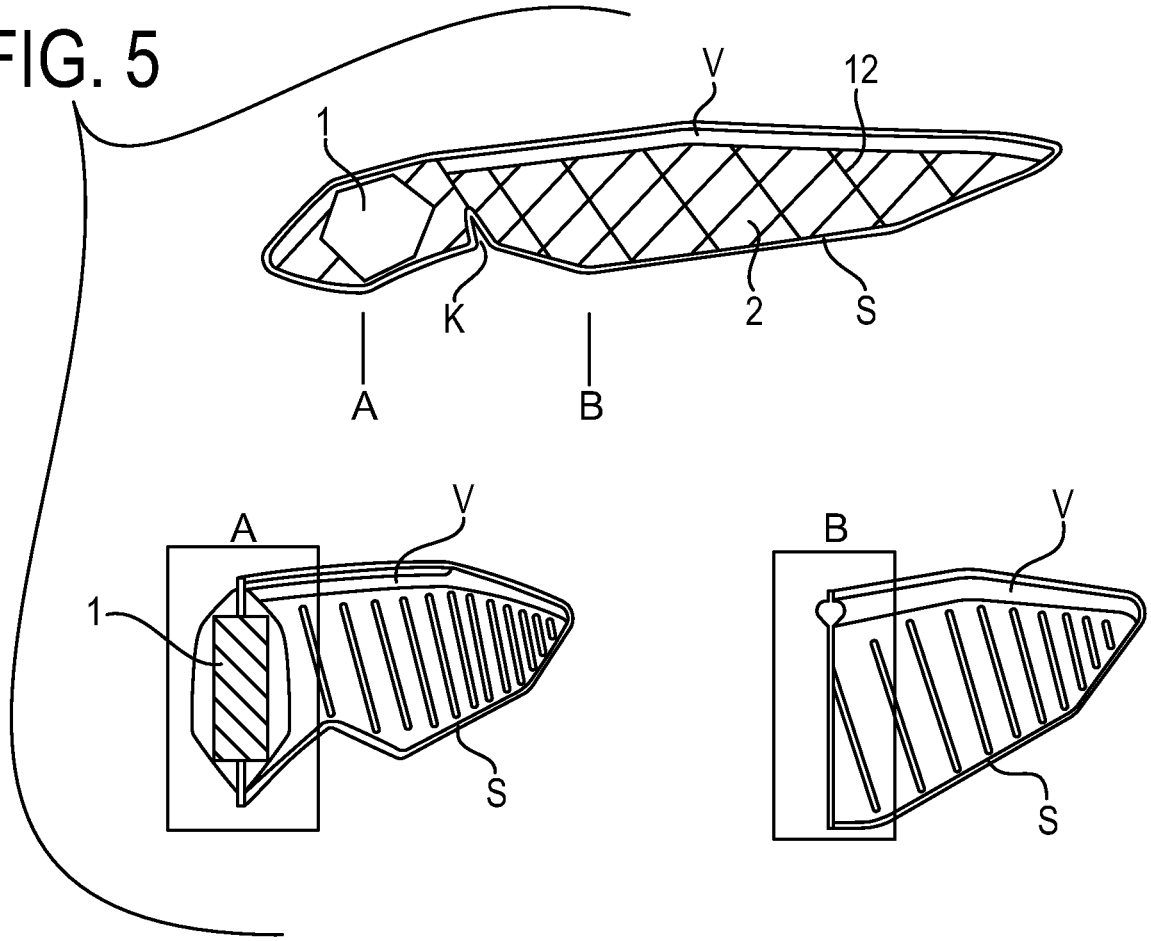
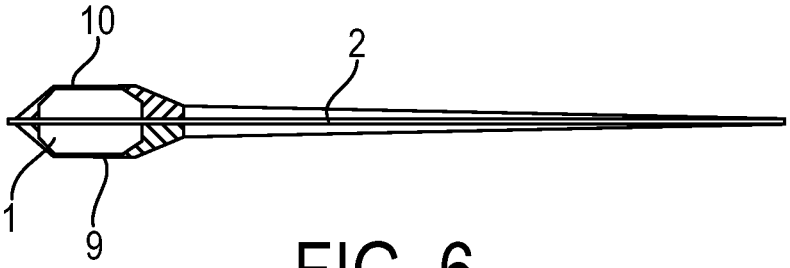
FIG. 6

FIG. 13
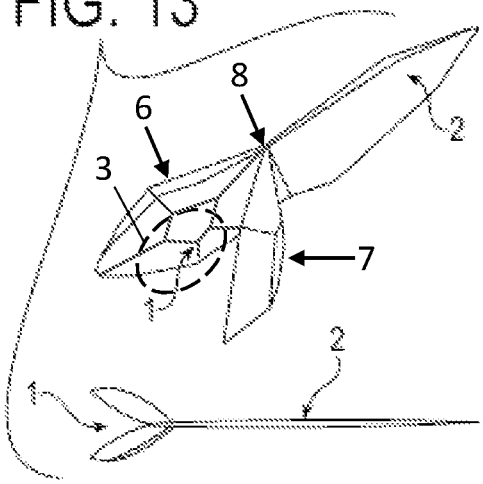
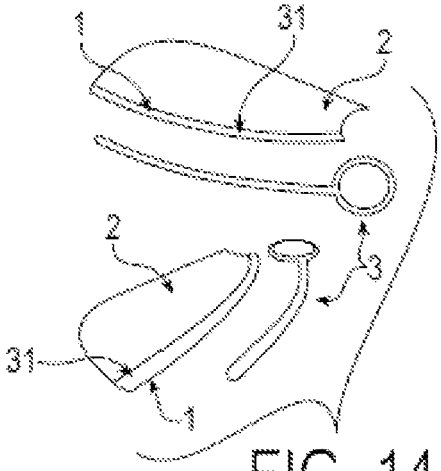
FIG. 14
FIG. 15
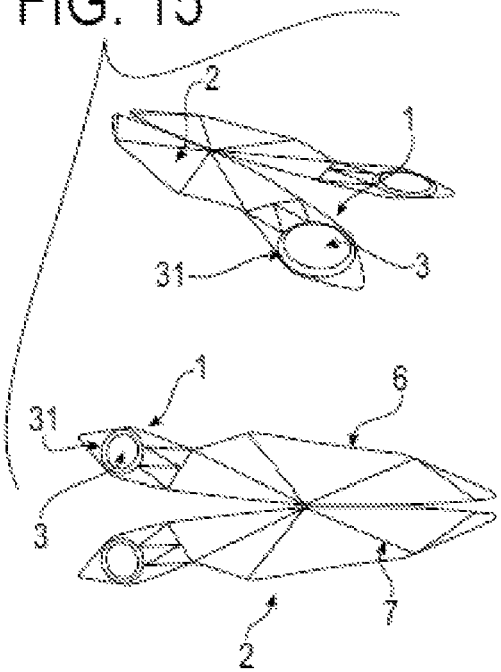
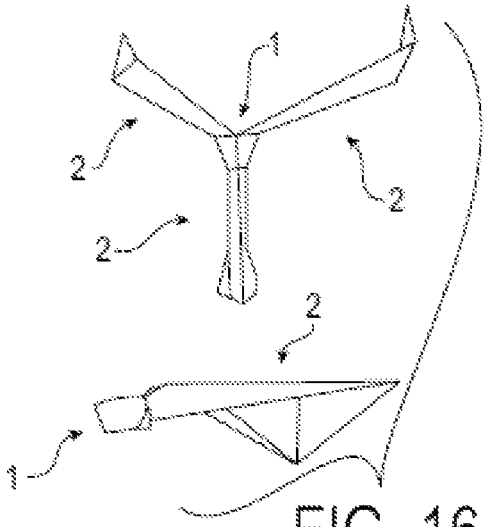
FIG. 16

PACKAGING HAVING MEANS FOR PASSIVE FLIGHT

CROSS-REFERENCES TO RELATED APPLICATIONS

This application is a divisional of U.S. patent application Ser. No. 13/512,252, filed May 25, 2012, which is a 35 U.S.C. § 371 of International Application No. PCT/DE2010/075142, filed Nov. 24, 2010, which claims the priority of German Patent Application, Serial No. 10 2009 055 616.8, filed on Nov. 25, 2009.

FIELD OF THE INVENTION

The invention relates to a packaging which performs a passive flight motion, in particular a gliding and/or autorotation motion, during free fall.

The invention also relates to a method for producing a packaging according to the invention.

Furthermore, the invention relates to a packaged good with a packaging.

DESCRIPTION OF RELATED ART

U.S. Patent No. US2008/0274663A1 discloses pieces of confetti which essentially have the shape of falling maple seed. Furthermore, U.S. Patent No. 2008/0226848A 1 discloses a piece of confetti constructed of water soluble material, for example rice paper. These known pieces of confetti perform a rotary motion during free fall, but they are not designed as a packaging for any products, for example candies.

In addition, DE 299 07 052 U1 discloses a bottle equipped with a parachute. Said bottle along with its parachute performs a pure falling motion.

BRIEF SUMMARY OF THE INVENTION

The primary object of the present invention is to create a packaging for objects, preferably smaller objects such as candies, liquids, powder or other things, which has improved flying characteristics during free fall and, in particular, performs a passive flight motion, in particular a gliding and/or autorotation motion.

The invention encompasses the technical teaching according to which, for a packaging which performs a passive flight motion, in particular a gliding and/or autorotation motion, during free fall, it is provided that the packaging has at least one wing, in particular at least one gliding wing and/or one rotor blade, and at least one accommodating space for an object to be packaged.

For the purposes of the present invention, packaging particularly means a specifically applied, detachable wrapping of a product. Said wrapping completely or just partially encloses the object. The packaging includes containers such as tubes, buckets, cases, cans, or similar things having an accommodating space for the object to be packaged. The packaging protect the packaged object from environmental influences, damages, soiling and/or loss. Besides protecting the packaged good, the packaging also protects human beings handling the packaging, for example from injuries and the like. Furthermore, depending on the embodiment, the packaging is suited for the preservation of food, for example by an airtight design of the accommodating space. In one embodiment, the packaging has an area for labeling the product or other things. To this end, a corresponding field or an area to be printed or to be otherwise identified by a mark is provided. One embodiment provides energy-using signal generators for indications, LEOs, lights, acoustic signal generators or the like. In that case, the packaging has a space or a section for a power supply. In one embodiment, electric power is supplied by solar energy. To this end, a corresponding solar system is provided, for example on the wing. In other embodiments, electric power is supplied by a battery or the like. By way of example, the battery is rechargeable, for example by moving the packaging. One embodiment provides a centrifugal switch or the like for connecting a power supply. Other embodiments provide areas for not energy-using advertising vehicles.

The packaging according to the invention has at least one accommodating space in which an object can be inserted, the weight of the accommodating space along with the inserted object being higher than the weight of the rotor blade sticking out sideways from the accommodating space. In an embodiment with the rotor blade sticking out to one side, this weight distribution causes the gravity of the complete assembly to shift towards the accommodating space so that the packaging rotates approximately around this gravity. As a result of the autorotation, the object along with the packaging enclosing it slowly falls to the ground while rotating and is substantially protected from damage. Thus, even parts sensitive to shock, such as chocolates, can be inserted into the accommodating space. One embodiment provides that at least one gliding wing is provided. This allows the packaging with the packaged object to perform a passive gliding flight so that the packaging slowly glides to the ground. All in all, the packaging thus comprises means for performing a passive flight, that is a gliding or (auto) rotation motion, which allows the packaging to hit the ground at reduced speed. Means for a passive flight do not comprise parachutes as they allow a pure falling motion. The packaging is caused to perform a free fall by an airplane or by a distance from the ground, for example. In another embodiment, the packaging is projected, for example thrown or fired, from the ground to the air so that the packaging, after having been projected to the air, undergoes a transition to free fall. In the case of a corresponding transition, the time of the free fall is relatively short, and the packaging starts immediately, for example, or after a minimal period of time to perform a passive flight, for example a gliding flight.

The packaging has at least one wing. In other embodiments, the packaging is designed with several wings. Furthermore, the packaging has at least one accommodating space. Other embodiments provide several accommodating spaces, in particular accommodating spaces which are spaced apart from each other. The accommodating spaces can be fluidically connected to each other or separated from each other.

In one embodiment, the wing is designed eccentric in relation to the accommodating space. In the case of several wings, the wings are arranged symmetrically to the accommodating space. In yet another embodiment, the wings are at least partially designed asymmetrical to the accommodating space.

The accommodating space and the inserted object have a total weight GA which is preferably a multiple of the weight GR of the wing or the rotor blade. The packaging as a whole has a weight G. Very good autorotation results have been achieved with a weight distribution in which the weight GA was seven times to ten times the weight GR. Other weight distributions, however, have also led to good flight characteristics.

In this respect, one embodiment of the present invention provides the weight GA to be a multiple of the weight GR, preferably about 1.5 times to about 15 times, more preferably about 5 times to about 12.5 times, and most preferably about 7 times to about 10 times the weight GR.

According to yet another embodiment of the present invention, the packaging is designed in several parts, in particular with a separate wing and a separate accommodating space which are releasably or permanently connected to each other. This allows, for example, to produce the accommodating space and the wing in separate process steps. For example, it is possible to insert the object in the accommodating space and then to connect the accommodating space to the wing. In another embodiment, the packaging is performed in a packaging step. That is, the object is packaged simultaneously and/or in one process step with the production step of the packaging.

Another embodiment of the present invention provides that the accommodating space is partially integrated in the wing. In one embodiment, the accommodating space projects into the interior of the wing. In another embodiment, the accommodating space extends on the exterior of the wing. According to one embodiment, the accommodating space is completely closed to the exterior environment. In another embodiment, the accommodating space at least partially opens to the exterior environment. By way of example, the accommodating space is only fixed by holding means for holding an object to be packaged.

Another embodiment of the present invention provides that the packaging, in particular the accommodating space and/or the wing, is/are tight, in particular airtight and/or gastight. A tight accommodating space or, in the case that the accommodating space is integrated in the wing, for example, a tight wing allows to also put a liquid, a gas and/or a powder in the packaging. The packaging is in particular designed to withstand overpressure. In this way, an air cushion for the packaged object can be realized by means of the packaging. The packaging is in particular gastight up to pressures of preferably about 2 MPa, in particular also up to about 1 MPa, most preferably up to about 0.5 MPa.

Advantageously, the packaging can be comprised of at least two packaging halves which can be opened and closed via a hinge such as a film hinge or another connecting element or are otherwise joined. Such a packaging can have an engaging element on the opposite side of the hinge which allows secure closure. Preferably several connecting elements and/or engaging elements are provided. Additionally, a latching element or locking element may be provided.

Alternatively, one embodiment provides that the packaging is designed in one piece. In this way, the packaging along with the accommodating space and the wing can be produced together in one production step. Complex assembly steps, for example connecting the wing to the accommodating space, are thus no longer required. Packaging of the object to be packaged is preferably done together with the production of the one-piece packaging.

It can be advantageous to make the packaging from a dimensionally stable biomaterial, in particular from a renewable raw material. For higher stability requirements, the packaging can also be made from a substantially dimensionally stable plastic material as a one-piece injection molded part.

A preferred embodiment of the present invention therefore provides that the packaging, the accommodating space and/or the wing is made of a thin-walled, dimensionally stable material, in particular a biomaterial, comprising textile materials, fabric materials, viscose materials, cellulose materials, starch, cornstarch, potato starch, foil, metal foil, plastic foil, paper foil, composite foil, hybrid materials, water soluble materials, compostable materials, biodegradable materials, rice, corn or gelatin. Other embodiments provide corresponding composite materials or mixtures of these compounds.

Furthermore, one embodiment provides that the packaging, the accommodating space and/or the wing is designed from a vacuum shrink packaging, a blister packaging or another substantially dimensionally stable packaging, such as a plastic packaging or a metal foil.

The size of the accommodating space of the packaging is preferably adapted to the size of the inserted object so as to achieve optimum flight characteristics. This size adaptation allows above all that the inserted object is completely encompassed by the packaging enclosing it and is held in its relative position to the packaging.

One embodiment of the present invention therefore provides that, for receiving a candy, a liquid, a powder, or another object having a given external dimension, such as a given external diameter, the packaging has an accommodating space with at least approximately the same internal dimensions or the same internal diameter. In another embodiment, the packaging is not adapted to the shape of the object to be accommodated. To ensure nonetheless that the object to be packaged is securely held in position, holding means or filling materials are provided, for example, which at least partially fill the remaining space between the object and the accommodating space.

Furthermore, it is advantageous if the rotor blade/rotor blades sticking out has/have a length which is more than three times the diameter of the accommodating space. Besides, it is advantageous to determine the width of the rotor blades in such a manner that it ranges from one time to two times the diameter of the accommodating space.

One embodiment of the present invention therefore provides that the wing/wings sticking out from the accommodating space, in particular the rotor blades, has/have a length which is more than about 1.5 times, preferably more than three times the diameter of the accommodating space and/or has/have a width which is at least one time to two times the diameter of the accommodating space. The accommodating space can have any shape. The preferred shape is spherical, but also other shapes are conceivable. In this case, diameter means the external dimension of the accommodating space, by analogy, for example, with the understanding of a hydraulic diameter in fluid dynamics for not circular pipe cross sections.

Moreover, one embodiment of the present invention provides that the at least one wing, in particular the at least one rotor blade, sticks out sideways from the accommodating space. According to yet another embodiment of the invention, the packaging has transverse reinforcement bars, at least in the area of the wing, in particular in the area of the rotor blade. The package can have approximately the shape of falling seeds, samaras, such as falling maple seeds, or the asymmetric shape of falling seeds of a tree of heaven (Latin: Ailanthus altissima). It is particularly advantageous to make the packaging from a thin-walled material and to equip it with transverse ribs to reinforce the wing surfaces, in particular the rotor surfaces. If the packaging is made from a thin-walled plastic foil, these transverse ribs can be produced by corresponding linear heating bars during the forming process. Other production methods, such as compressing, folding, crumpling, or the like are also applicable, of course. Therefore, according to one embodiment, the packaging has transverse reinforcement bars, at least in the area of the wing, in particular in the area of the rotor blade.

Furthermore, according to one embodiment of the present invention, the accommodating space has opening means for easier opening, for example a perforation, a tear strip, a hinge, a material weakness, or the like. This makes opening easier for the user, in particular in the case of firmly closed packagings. In addition, undesired opening, for example by environmental influences, is prevented.

According to another embodiment of the present invention, a filling material is provided in the accommodating space which at least partially encloses the object to be packaged, comprising liquids, gases, solids, in particular a pressurized gas such as air, small solid state materials, and the like. This allows to also package heavy objects by means of the packaging according to the invention. To this end, a gas which is lighter than air can be introduced as a filling material in the accommodating space, similar to the functional principle of an airship. The filling material then provides buoyancy. In addition, appropriate filling materials help to improve the impact characteristics when alighting on the ground, thus providing additional protection for a packaged object. The filling materials can be made from any material, in particular from the same material used to produce the packaging. Packaging residues accumulating during the production of the packaging, for example, can thus be used as filling material.

According to yet another embodiment of the present invention, holding means are provided on the wing and/or the accommodating space to hold the packaged object on the wing or in the accommodating space. To prevent the packaged object from moving during the passive flight, for example, holding means preventing undesired movements are provided. For example, the object is held in the accommodating space or on or in the wing by positive fit and/or force fit. For example, a part of the object, such as the stick of a lollipop, can thus be used as a stabilizer in the wing and/or the accommodating space. In one embodiment, a straw is attached to the wing, for example, thus reinforcing the wing and/or forming a flow directing means. In the event that a liquid is packaged in the accommodating space and/or the wing, that is in the packaging, the straw is designed to be removable from the wing, and the liquid can be removed from the packaging through the straw.

Furthermore, in another embodiment of the present invention, the wing has flow directing means, comprising a tripwire, nozzle elements, ribs, recesses, integrally formed parts, openings, and the like to improve the flight characteristics of the packaging. Thanks to such means, the air flow around and/or against the wing is adapted to the respective situation. If such flow directing means are provided, turbulences, laminar flows, turbulent flows, stalls, and the like, for example, can be applied in a targeted manner.

Furthermore, the invention includes the technical teaching that in a method for producing a packaging according to the invention it is provided that the packaging of the object is done in one step together with the production of the packaging, in particular simultaneously, or that the packaging of the object is done in a step separated from the production of the packaging and/or the accommodating space and/or the wing, in particular successively.

In one embodiment of the invention, the packaging can be produced from two plastic foils. Said plastic foils are pressed against, pushed against and/or welded on the accommodating space from both sides by means of a tool. In this embodiment, said tool comprises two tool halves which are moved against each other. Foil feeding is done by the advantageously synchronous unrolling of two rolls, for example. Advantageously, an object can be inserted in the accommodating space already during the production process or at a later time.

In another embodiment, the foil feeding is done from only one roll. Advantageously, it is not necessary to run two rolls synchronously, which is very difficult and prone to errors for a foil packaging which, on both sides, shall be symmetrically opposite each other, where possible.

The invention not least includes the technical teaching that, for a packaged good with a packaging, it is provided to design the packaging as a packaging according to the invention and to hold the packaged good in the accommodating space.

Further provisions improving the invention are specified in the subclaims or will become apparent from the following description of embodiments of the invention which are schematically represented in the Figures. Identical or similar components or features are identified with the same reference signs. Features or components of different embodiments may be combined to achieve further embodiments. All the features and/or advantages disclosed in the claims, the description or the drawings, including design details, spatial arrangements and process steps, may be essential to the invention, both individually and in a great variety of combinations.

BRIEF DESCRIPTION OF THE SEVERAL VIEWS OF THE DRAWING(S)

Referring to the drawings,

FIG. 5-FIG. 7 are different views of a packaging which can be opened and closed via a hinge and has one rotor blade sticking out from the accommodating space;

FIG. 13 shows two views of an embodiment of the packaging having an accommodating space which can be opened via a hinge;

FIG. 14 shows two views of an embodiment having an accommodating space which is partially integrated in the wing;

FIG. 15 shows a two-piece embodiment having halves which can be opened and closed via a hinge, once in closed position and once in open position; and FIG. 16 shows two views of a one-piece embodiment of the packaging having three wings.

DETAILED DESCRIPTION OF THE INVENTION

Figure 1:
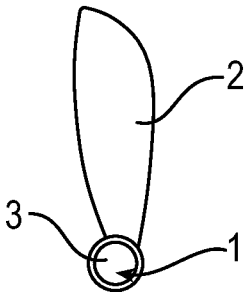
FIG. 1 is a top view of a packaging with a rotor blade.

The top view of FIG. 1 shows a packaging approximately resembling the shape of the falling seeds of maple trees and having an accommodating space 1 for accommodating an object to be packaged. A rotor blade 2 sticking out from the accommodating space 1 causes the such designed packaging to perform an autorotation during free fall and slowly glide to the floor. The ball-shaped object 3 inserted in the accommodating space 1 has a diameter which is only very slightly smaller than the accommodating space 1 enclosing it. The object 3 is a candy, for example.

Figure 2:
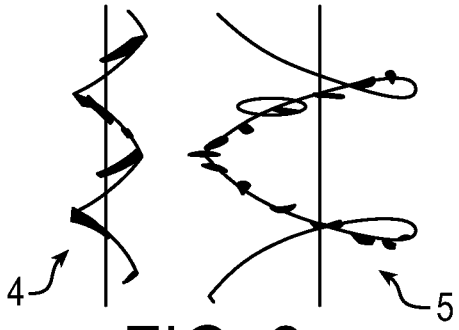
FIG. 2 is a schematic representation of two different flight paths.

FIG. 2 shows two possible flight paths 4, 5 which might result if the rotor blades are different in size compared to the size of the accommodating space.

Figure 3:
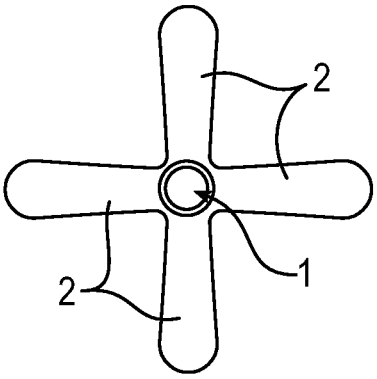
FIG. 3 shows a packaging having four rotor blades sticking out from its accommodating space.

FIG. 3 shows a packaging having a centrally arranged accommodating space 1 with four rotor blades 2 sticking out from it.

Figure 4:
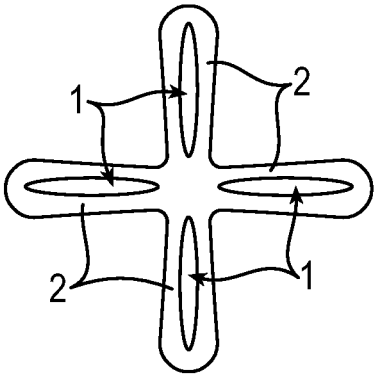
FIG. 4 shows a packaging having rotor blades arranged in a star shape in which are located the accommodating spaces.

In the embodiment of FIG. 4, the accommodating spaces 1 are located in the rotor blades 2.

Figure 7:
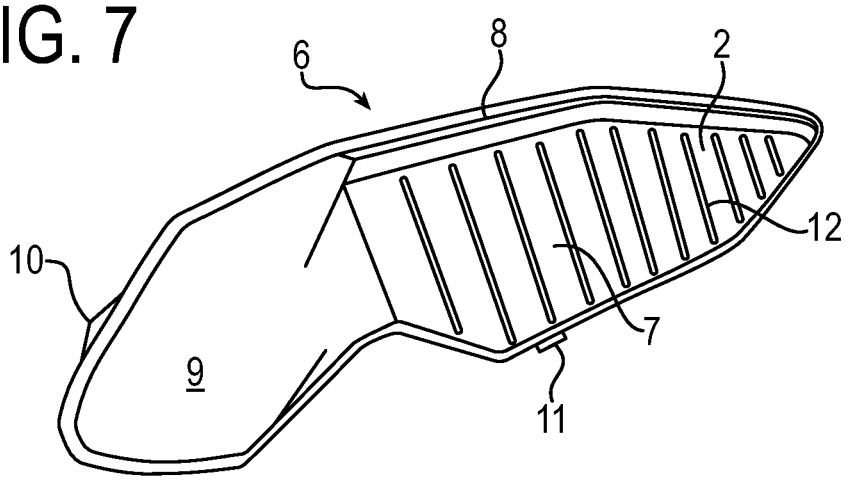

The three views of FIG. 5 to FIG. 7 show a dimensionally stable packaging which can be opened and closed via a hinge and can be made from plastic or another dimensionally stable material. The two mirror-symmetric halves 6, 7 of the packaging are pivotably connected to each other by a film hinge 8. The two convex side parts 9, 10 enclose the accommodating space 1 from which the rotor blade 2 sticks out.

An opening notch K formed between the accommodating space 1 and the rotor blade 2 facilitates the opening of the accommodating space 1. The two halves 6, 7 (FIG. 7) can be connected to each other through a weld seam or a bond seam S (FIG. 5). Furthermore, a reinforcement strain V can extend in longitudinal direction of the rotor blade 2.

An engaging element 11 not shown in detail here which, in closed state, releasably connects the two rotor blade halves to each other can be provided on the side opposite the film hinge 8.

Laterally transversely extending reinforcement bars 12 which, in the case of a plastic packaging, can be designed as correspondingly more thick-walled ribs are formed on the rotor blade 2 to increase the rigidity of the latter. Corresponding reinforcement bars 12 can also be formed simply by linear surface-fusing under the effect of heat.

Figure 8:
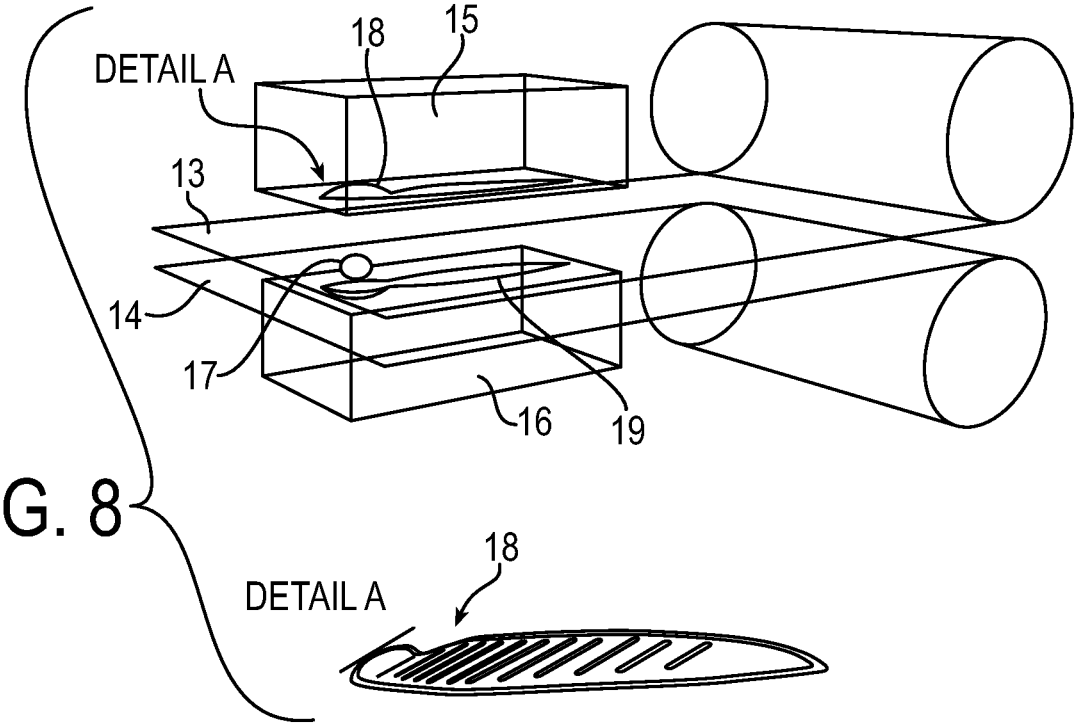
FIG. 8 is a simplified perspective representation of a device for producing a packaging made of two plastic foils.

FIG. 8 schematically shows how a packaging like the one represented in FIG. 5 to FIG. 7, for example, can be produced using two foil webs 13, 14 and two tool halves 15, 16. The object which is to be inserted in the accommodating space, such as a candy 17, can be introduced in the accommodating space during the production process or at a later time. The upper tool half 15 is moved downwards, whereas the lower tool half 16 is moved upwards to give the packaging its shape. The foil webs 13, 14 are preferably synchronously unrolled from two rolls and can be placed against the protrusions 18, 19 of the tool halves 15, 16 by means of a vacuum. The circumferential outer edges are welded to each other under the effect of heat, so as to produce linear reinforcement bars 12 which can be seen more clearly in FIG. 5 and FIG. 7. The detail A of FIG. 8 shows the upper part of a forming punch with the protrusions 18.

Another embodiment of the device for producing a packaging from two plastic foils according to FIG. 8 provides that the foil webs 13, 14 are unrolled from one roll only. This has the advantage that it is not necessary to run two rolls synchronously.

Figure 9:
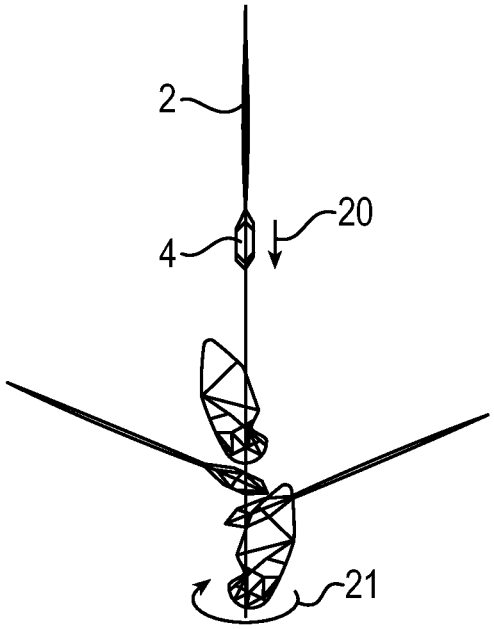
FIG. 9 shows the transition from the free fall to the autorotation of a packaging which has a rotor blade sticking out sideways from the accommodating space.

FIG. 9 illustrates how a packaging having a rotor blade 2 sticking out from one side of the accommodating space 1 initially falls in the direction of the arrow 20 during free fall and then starts to perform a decelerated descent while making an autorotation, which is indicated by the arrow 21.

Figure 10:
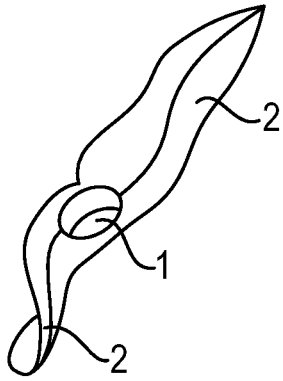
FIG. 10-FIG. 11 are representations of asymmetric packagings having approximately the shape of falling seeds of the tree of heaven.
Figure 11:
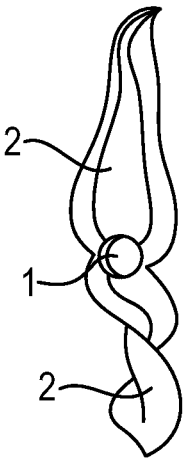

The packagings represented in FIG. 10 and FIG. 11 have an asymmetrically arranged accommodating space 1 from which stick out a longer and a shorter rotor blade 2 each. The here shown packaging is preferably made from an inflexible deformable foil, preferably a metal foil. Generally, it is also possible to make the packaging from a biomaterial or another plastic material. In the represented embodiment, the accommodating space 1 is designed in such a manner that an object can be inserted in a self-clamping manner. Generally, however, the accommodating space 1 can also be provided with a cover or wrapping which encloses the accommodating space 1.

Figure 12:
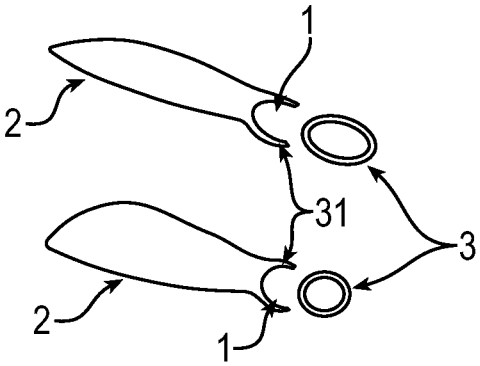
FIG. 12 shows two views of an embodiment of the packaging with an object and a removable wing.

FIG. 12 shows two views of an embodiment of the packaging with an object 3 and a detachable wing 2. The accommodating space 1 is fixed by the holding means 31, that is, in this embodiment, the accommodating space 1 is not designed to enclose the object 3. The holding means 31 conform to the contour of the object 31 to be accommodated so as to hold it in the accommodating space 1 by positive fit and/or force fit. The holding means 31 are designed in one piece with the wing 2. The wing 2 is thus reusable. The connection can be reversible or irreversible, for example welded or glued or force-fit and/or positive-fit.

FIG. 13 shows two views of an embodiment of the packaging having an accommodating space 1 which can be opened via a hinge 8. In this embodiment, the accommodating space 1 is formed by two hinged halves 6 and 7 of the accommodating space 1 which can be locked together or engaged with one another. This embodiment can also be reused several times. The removal of the packaged object, which is here shown in a dotted line, is facilitated by the fact that the accommodating space 1 can be opened via a hinge 8 without the packaging being destroyed. In this embodiment, the wing 2 is integrally connected to the accommodating space 1. The two halves 6 and 7 of the accommodating space 1 are connected to each other by a film hinge 8.

FIG. 14 shows two views of an embodiment with the accommodating space 1 being partially integrated in the wing 2. Similar to the embodiment according to FIG. 12, the accommodating space 1 is fixed again by holding means 31. The holding means 31 or the accommodating space 1 extends along the edge of the wing 2. The holding means 31 have a clip type design and conform to the contour of the object 3 to be accommodated. Here, the object 3 to be accommodated is designed as a lollipop. The stick of the lollipop is held by the holding means 31. The head of the lollipop is arranged in the correspondingly shaped accommodating space 1 on the side of the wing.

FIG. 15 shows a two-piece embodiment with folding halves 6 and 7, once in closed and once in open state. The packaging is designed in one piece. The two halves 6, 7 are connected to each other by a film hinge 8. This embodiment can also be reused several times as the wings 2 and the accommodating space 1 can be opened to allow for the easy removal of the object 3 without destroying the packaging. The object 3 is held in the accommodating space 1 by holding means 31 by positive fit and/or force fit. Accordingly, the holding means 31 conform to the shape or contour of the object 3.

FIG. 16 shows a one-piece embodiment of the packaging having three wings 3. The accommodating space 1 is located in the center of the three wings 2. The wings are foldably connected to each other. The three wings 2 induce a particular tumbling motion of the packaging.

The invention claimed is:

1. A packaging comprising:

at least one accommodating space configured for an object to be inserted therein, the at least one accommodating space being openable via a hinge, and at least one wing extending from the at least one accommodating space along a length of an outer periphery of the at least one accommodating space, the at least one wing causing an autorotation motion of the packaging during free fall;

wherein the at least one hinge is disposed along an entirety of the length of the outer periphery of the at least one accommodating space from which the at least one wing extends.

2. The packaging according to claim 1, wherein the at least one accommodating space is comprised of at least two hinged halves pivotably connected to each other via the at least one hinge.

3. The packaging according to claim 2, wherein the at least one wing is integrally connected to the at least one accommodating space.

4. The packaging according to claim 1, wherein the at least one hinge is a film hinge.

5. The packaging according to claim 1 further comprising the object inserted in the at least one accommodating space.

* * * * *